United States Patent [19]

Tennihan

[11] Patent Number: 4,955,068

[45] Date of Patent: Sep. 4, 1990

[54] LEAF DISPOSAL BAG

[76] Inventor: Robert Tennihan, 18 Timothy Dr., W. Bridgewater, Mass. 02379

[21] Appl. No.: 278,479

[22] Filed: Dec. 1, 1988

[51] Int. Cl.[5] ..... B65D 30/00; B65B 3/16

[52] U.S. Cl. ..... 383/4; 52/165; 52/512; 141/114; 141/314; 141/391; 383/76; D8/391

[58] Field of Search ..... 383/72, 73, 74, 75, 383/76, 77, 10, 4; 141/114, 314, 390, 391; 248/95, 97, 98, 100, 101, 99; 15/257.1; 52/410, 512, 165, 157, 694, 617, 237; 411/481, 533; 135/118; 4/580, 581, 498, 503; 24/49 P, 49 A, 711.4, 711.5; D8/1, 388, 391

[56] References Cited

U.S. PATENT DOCUMENTS

| | | | |
|---|---|---|---|
| D. 218,582 | 9/1970 | Kiester | 135/118 |
| 977,129 | 11/1910 | Reynolds | 383/4 X |
| 1,358,465 | 11/1920 | Reston | 24/49 P |
| 2,479,203 | 8/1949 | Brown . | |
| 2,625,695 | 1/1953 | Nichiolson . | |
| 3,229,309 | 1/1966 | Knodel | 4/503 |
| 3,599,690 | 8/1971 | Christie . | |
| 3,687,357 | 8/1972 | Hansen . | |
| 4,366,949 | 1/1983 | Staub, Sr. | 383/4 |
| 4,682,447 | 7/1987 | Osborn | 383/4 X |

*Primary Examiner*—Daniel P. Stodola
*Assistant Examiner*—William G. Battista, Jr.
*Attorney, Agent, or Firm*—Jerry T. Kearns

[57] ABSTRACT

A leaf disposal bag is formed from a large diameter thin plastic circular sheet. A drawstring is woven through a plurality of evenly spaced apertures provided around a peripheral edge of the circular sheet. A pair of radially extending tabs are formed at diametrically opposed locations on the sheet and each receive a ground insertion spike for retaining the circular sheet in a flat open condition on the surface of the ground. In use, leaves to be disposed are piled upon the upper surface of the circular sheet. Upon collection of a sufficiently large volume of leaves, the ground insertion spikes are withdrawn from the ground and the drawstring is tightened to close the circular sheet into a closed bag. The ground insertion spikes may be formed as a separable enlarged head portion and a sharpened shank portion having a mating frusto conical plug and socket connection.

1 Claim, 3 Drawing Sheets

LEAF DISPOSAL BAG

BACKGROUND OF THE INVENTION

1. Field of the Invention

The present invention relates to bags, and more particularly pertains to a new and improved leaf disposal bag. In many areas of the country local ordinances prevent the burning of fallen leaves. In order to dispose of such leaves, individuals must rake them and collect them in disposal bags. The insertion of a pile of raked leaves into a conventional plastic bag is a difficult and frustrating task, especially for a single individual. In order to overcome this problem, the present invention provides a leaf disposal bag which opens to a completely flat position which enables the leaves to be merely piled on an upper surface thereof and subsequently enclosed by closing the bag around the leaves.

2. Description of the Prior Art

Various types of bags are known in the prior art. A typical example of such a bag is to be found in U.S. Pat. No. 2,479,203, which issued to G. Brown on Aug. 16, 1949. This patent discloses a square sheet provided with a plurality of circular rings secrued by tabs and arranged on a circular array. A circular cord is threaded through the rings and forms a drawstring which enables the square sheet to be closed to a bag-like configuration. U.S. Pat. No. 2,625,695, which issued to J. Nicholson on Jan. 20, 1953, discloses a sleeping bag made of paper and provided with a drawstring closure. U.S. Pat No. 3,599,690, which issued to J. Christie on Aug. 17, 1971, discloses a general purpose carrying bag having a tubular body with open and closed ends and a side wall opening containing a hand grip secured to the bag wall at opposite sides of the opening for holding and carrying the bag. A drawstring laced about the mouth of the bag has a free end which may be pulled to close the mouth and stored within the bag by insertion through the hand grip opening. U.S. Pat. No. 3,687,357, which issued to G. Hansen on Aug. 29, 1972, discloses a drawstring bag wherein a folded sheet of synthetic material is fed stepwise through an apparatus for folding the open edges of the sheet back upon themselves and producing a pair of seams. Apertures are subsequently punched therein and a drawstring is threaded through each seam.

While the above mentioned devices are suited for their intended usage, none of these devices disclose a bag formed from a large diameter flat circular sheet having a drawstring laced through apertures evenly spaced about a peripheral edge thereof. Additional features of the present invention not disclosed by the prior art devices include the provision of a flat circular sheet with a drawstring closure and a pair of radially extending tabs at diametrically opposed locations for the insertion of ground insertion retaining spikes. Additionally, none of the aforesaid devices disclose the use of a two piece ground insertion spike having an enlarged head portion and a separable sharpened shank portion with a mating frusto conical plug and socket connection for capturing the radially extending tab of the circular sheet. Inasmuch as the art is relatively crowded with respect to these various types of bags, it can be appreciated that there is a continuing need for and interest in improvements to such bags, and in this respect, the present invention addresses this need and interest.

SUMMARY OF THE INVENTION

In view of the foregoing disadvantages inherent in the known types of bags now present in the prior art, the present invention provides an improved leaf disposal bag. As such, the general purpose of the present invention, which will be described subsequently in greater detail, is to provide a new and improved leaf disposal bag which has all the advantages of the prior art bags and none of the disadvantages.

To attain this, representative embodiments of the concepts of the present invention are illustrated in the drawings and make use of a large diameter thin plastic circular sheet. A drawstring is woven through a plurality of evenly spaced apertures provided around a peripheral edge of the circular sheet. A pair of radially extending tabs are formed at diametrically opposed locations on the sheet and each receive a ground insertion spike for retaining the circular sheet in a flat open condition on the surface of the ground. In use, leaves to be disposed are piled upon the upper surface of the circular sheet. Upon collection of a sufficiently large volume of leaves, the ground insertion spikes are withdrawn from the ground and the drawstring is tightened to close the circular sheet into a closed bag. The ground insertion spikes may be formed as a separable enlarged head portion and a sharpened shank portion having a mating frusto conical plug and socket connection.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved leaf disposal bag which has all the advantages of the prior art bags and none of the disadvantages.

It is another object of the present invention to provide a new and improved leaf disposal bag which may be easily and efficiently manufactured and marketed.

It is a further object of the present invention to provide a new and improved leaf disposal bag which is of a durable and reliable construction.

An even further object of the present invention is to provide a new and improved leaf disposal bag which is susceptible of a low cost of manufacture with regard to both materials and labor, and which accordingly is then susceptible of low prices of sale to the consuming public, thereby making such bags economically available to the buying public.

Still yet another object of the present invention is to provide a new and improved leaf disposal bag which provides in the apparatuses and methods of the prior art some of the advantages thereof, while simultaneously overcoming some of the disadvantages normally associated therewith.

Still another object of the present invention is to provide a new and improved leaf disposal bag which opens to a flat circular sheet to enable the rapid and efficient collection of leaves.

Yet another object of the present invention is to provide a new and improved leaf disposal bag which may be retained in a flat open condition at a desired location through the use of diametrically opposed ground insertion spikes.

Even still another object of the present invention is to provide a new and improved leaf disposal bag which enables a single individual to efficiently collect and dispose of fallen leaves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. such description makes reference to the annexed drawings wherein.

DESCRIPTION OF THE PREFERRED EMBODIMENT

Figure 1:
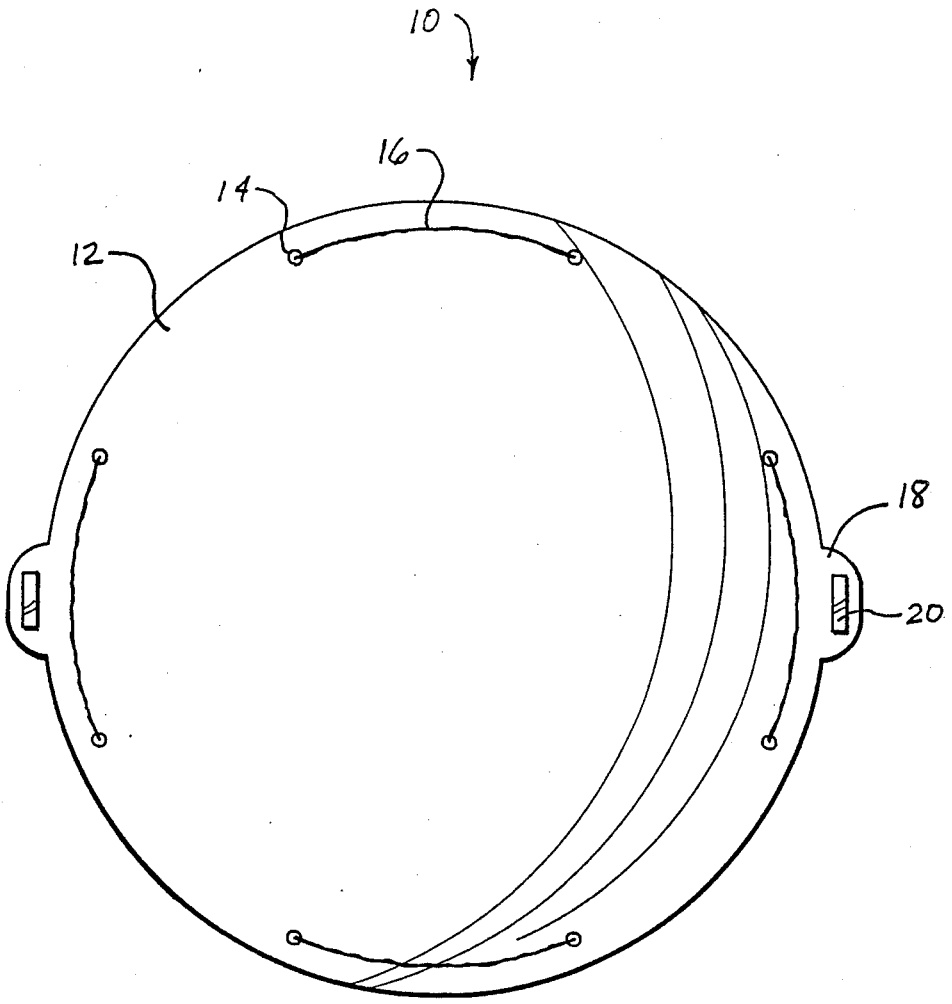
FIG. 1 is a top view of the leaf disposal bag of the present invention in an open condition.

With reference now to the drawings, and in particular to FIG. 1 thereof, a new and improved leaf disposal bag embodying the principles and concepts of the present invention and generally designated by the reference numeral 10 will be described.

More specifically, it will be noted that the first embodiment 10 of the invention includes a large diameter flat circular plastic sheet 12. The plastic material is preferably a 3 mm thick plastic sheeting. A plurality of apertures 14 are evenly spaced about the circumference of the plastic sheet 12, adjacent the outer peripheral circular edge thereof. A drawstring or cord 16 is woven through the spaced apertures 14 to facilitate closing of the bag. A pair of radially extending tabs 18 are provided at diametrically opposed locations on the outer periphery of the sheet 12. A ground insertion spike having an enlarged head portion 20 is received through each of the tabs 18. In use, the plastic circular sheet 12 is placed in the illustrated open and flat condition at a desired location on the surface of the ground and the spikes 20 are then inserted into the ground to retain the sheet in the open condition and in the desired location. A quantity of fallen leaves are then raked or piled upon the upper surface of the sheet 12. Upon the collection of a sufficient quantity of leaves, the insertion spikes 20 are withdrawn from the ground and the drawstring 16 is tensioned, to close the plastic sheet 12 about the accumulated leaves. This enables a single individual to efficiently collect and dispose of leaves. In contrast, the conventional form of tubular leaf disposal bag requires two individuals. One individual to hold the bag open and a second individual to insert the leaves.

Figure 2:
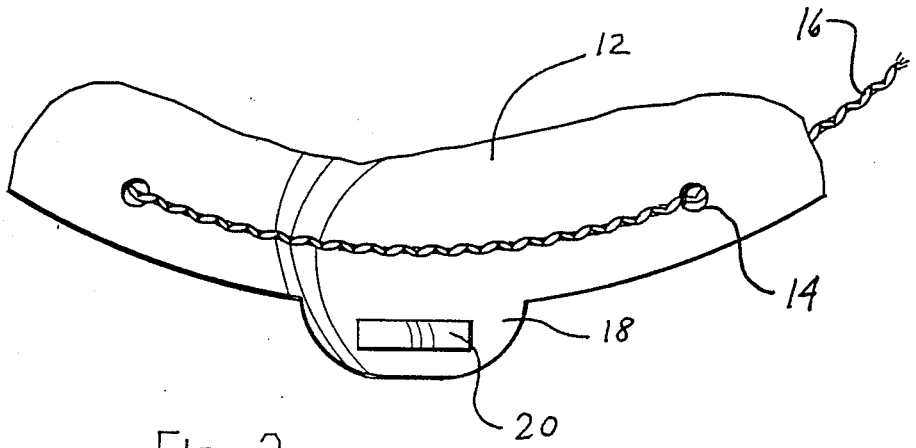
FIG. 2 is an enlarged detail view illustrating the drawstring closure and the ground insertion spike and retaining tab.

FIG. 2 provides an enlarged cut away detail view which illustrates the drawstring 16 woven through the apertures 14 adjacent the peripheral edge of the sheet 12 and the enlarged head 20 of a ground insertion spike received through the radial tab 18.

Figure 3:
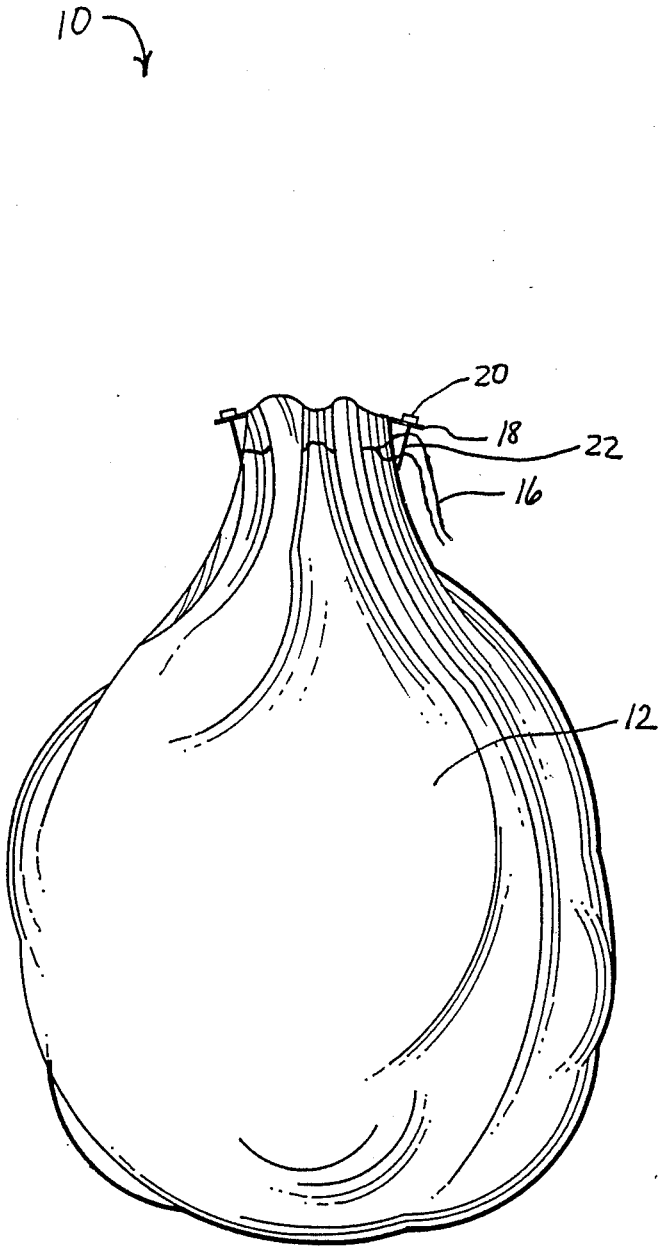
FIG. 3 is a perspective view illustrating the leaf disposal bag of the present invention in a closed position.

FIG. 3 provides a perspective view which illustrates the bag 10 of the present invention in a closed condition, with a quantity of leaves retained therein.

Figure 4:
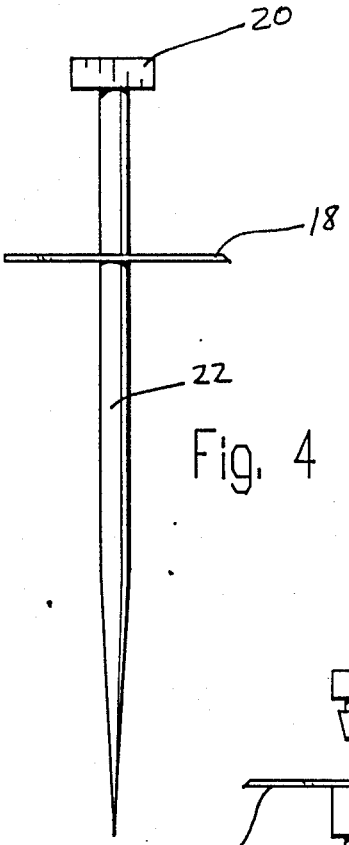
FIG. 4 is a side view of the ground insertion spike received through a retaining tab.

FIG. 4 provides a side view of the ground insertion spike received through the tab 18. The ground insertion spike has an enlarged head 20 which abuts a top surface of tab 18 and a sharpened shank portion 22 which extends through the tab 18 and is adapted for insertion into the ground.

Figure 5:
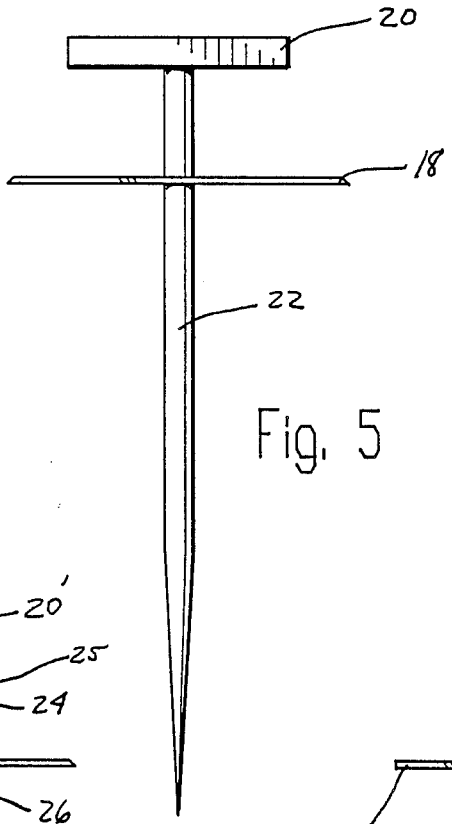
FIG. 5 is a front view of the spike of FIG. 4.

FIG. 5 provides a front view of the ground insertion spike of FIG. 4.

Figure 6:
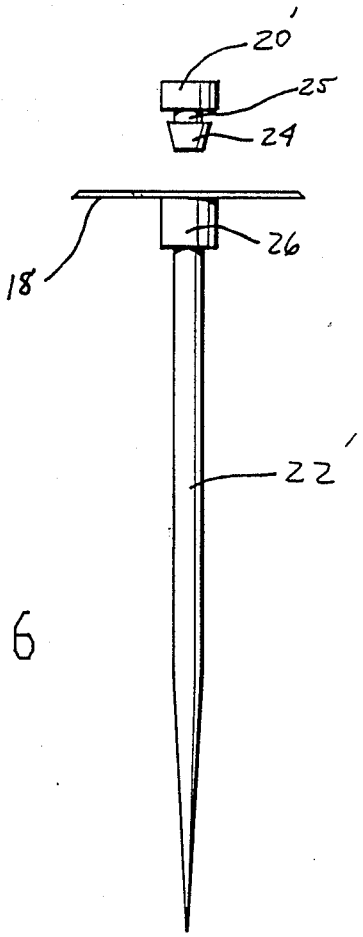
FIG. 6 illustrates a slightly modified form of ground insertion spike having separable head and shank portions.

FIG. 6 depicts a slightly modified ground insertion spike which has an enlarged head portion 20' provided with a frusto conical plug 24 and an adjacent reduced diameter neck portion 25. The separable sharpened shank portion 22' has a cooperating socket 26. In use, the socket 26 is disposed adjacent and in abutment with a bottom surface of the tab 18 and the frusto conical plug 24 of the head portion 20' is inserted through a small aperture in the tab 18 into the socket 26, thus securing the ground insertion spike to the radial tab 18. With this construction, the ground insertion spikes may be separated from the tabs 18 before disposal of the bag to allow the reusage thereof.

Figure 7:
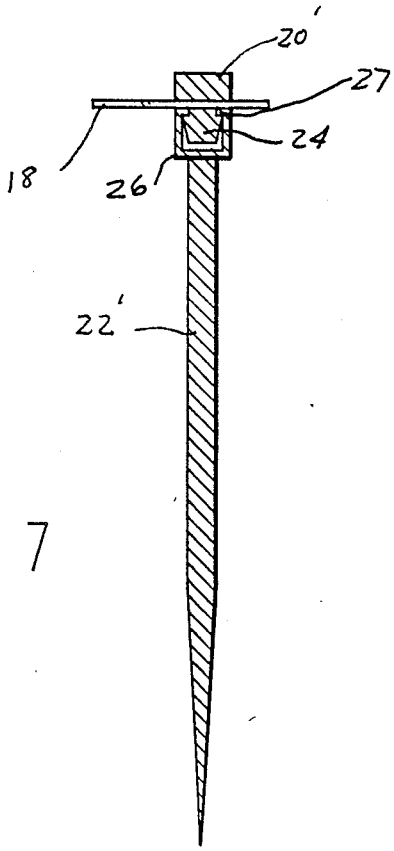
FIG. 7 is a longitudinal cross sectional view illustrating the ground insertion spike of FIG. 6 in an assembled condition.

FIG. 7 provides a longitudinal cross sectional view, which illustrates the frusto conical plug 24 of the enlarged head portion 20' received within the socket 26 on the separable shank portion 22'. The material forming the socket 26 and plug 24 are sufficiently resilient to allow insertion, but to prevent inadvertent retraction.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A leaf disposal bag, comprising:

a large diameter circular sheet;

a plurality of apertures spaced around a peripheral edge of said sheet;

a drawstring threaded through said apertures;

a pair of tabs disposed at diametrically opposite locations adjacent the peripheral edge of said circular sheet;

a ground insertion spike received through each of said tabs for retaining said sheet in a flat open condition;

each of said spikes having an enlarged head portion overlying an upper surface of one of said tabs;

each of said spikes having a separable shank portion terminating in a pointed tip adapted for ground insertion;

a frusto conical plug on said enlarged head portion, said plug formed from a resilient material and connected to said enlarged head by a reduced diameter cylindrical stem; and a mating socket on said separable shank portion, said socket formed from a resilient material and having a radially inwardly extending annular rim dimensioned for engagement with said reduced diameter cylindrical stem.

* * * * *